United States Patent [19]

Ikemoto

[11] Patent Number: 4,557,102

[45] Date of Patent: Dec. 10, 1985

[54] HAND WRAPPING APPARATUS

[76] Inventor: Shigeru Ikemoto, 36 Honmaeda-cho, Nakagawa-ku Nagoya, Japan

[21] Appl. No.: 536,998

[22] Filed: Sep. 29, 1983

[30] Foreign Application Priority Data

Oct. 12, 1982 [JP] Japan ..... 57-178842

[51] Int. Cl.[4] ..... B65B 57/04; B65B 11/02

[52] U.S. Cl. ..... 53/66; 53/219

[58] Field of Search ..... 53/64, 66, 219; 83/367, 83/370; 156/360, 361, 368

[56] References Cited

U.S. PATENT DOCUMENTS 3,486,293 12/1969 Van de Bilt ..... 53/66

3,540,187 11/1970 Monaghan ..... 53/66 X

*Primary Examiner*—Robert L. Spruill

*Assistant Examiner*—Michael D. Folkerts

*Attorney, Agent, or Firm*—Steele, Gould & Fried

[57] ABSTRACT

A wrapping apparatus comprises a film roll placed on a pair of support rollers, a film withdrawal port to introduce the film on the roll exterior, a severing tool to cut the film introduced through the port, a film length determiner to detect the leading end of the film partly thrown around product so as to calculate the successive length of the film required, a film length detector which detects the length of the film withdrawn as calculated by the determiner, and a brake assembly which is applied to the support roller to stop withdrawal of the film on the basis of signals generated from the detector. The amount of film on the roll that is withdrawn corresponds to the dimensions of the product to be wrapped.

1 Claim, 12 Drawing Figures

A
B
C
1
1a
4
6
7
11
12
13
14
15
16
17
18
19
20
21
21a
22
23
25
X
Y

HAND WRAPPING APPARATUS

BACKGROUND OF THE INVENTION

1. Field of the Art

The invention relates to a hand wrapping apparatus in which film on a film roll is manually pulled out to wrap a product such as food, and is cut by means of a severing structure.

2. Description of the Prior Art

In a hand wrapping apparatus of this type, film on a roll is first manually pulled out to be wrapped around a product from its topside to underside at the time of wrapping. The product is then moved to further withdraw the film to make an overlapped portion at the underside of the product, and the film is cut in the neigborhood of its overlapped portion by means of a severing tool such as a heater wire or the like.

Such is the construction that the length of the film that is pulled out invariably depends on intuitive judgment of the operator at the time of wrapping the product.

This results in the withdrawal of a different length of film each time when a product is wrapped. The problem is particularly apparent when a plurality of similarly dimensioned products are to be wrapped.

These differences in length cause surplus or shortage of the film upon wrapping the product, resulting in waste of the film for surplus, or failure of positive wrapping for shortage.

SUMMARY OF THE INVENTION

It is therefore a primary object of the present invention to provide a novel hand wrapping apparatus which will be effective in eliminating the above disadvantage of the prior art counterpart.

consequently, it is an object of the invention to provide a hand wrapping apparatus which is capable of pulling out the proper relevant length of film required for the product to be wrapped so as to prevent waste of the film, and at the same time, ensuring an execution of positive wrapping irrespective of the dimensions of the product, and where the leading edge of the film is positioned on the product upon wrapping.

According to the invention, there is provided a hand wrapping apparatus comprising a film roll supported on a pair of support rollers, a film withdrawal port to introduce the film as it is unwound from said roll, a severing structure to sever the film introduced through said port, a film length determiner structure to detect the leading end of the film as it is unwrapped around the product so as to calculate the successive length of the film required, a film length detector which detects length of the film withdrawn as calculated by said determiner structure, and a braking structure which is applied to the support roller to stop the withdrawal of the film.

The above and other objects, features and advantages of the present invention will become apparent from the following description and the appended claims, taken in conjunction with the accompanying drawings which show by way of example preferred embodiments of the present invention and in which like component parts are designated by like reference numerals throughout the various figures.

DETAILED DESCRIPTION OF THE PREFERRED EMBODIMENT

Figure 1:
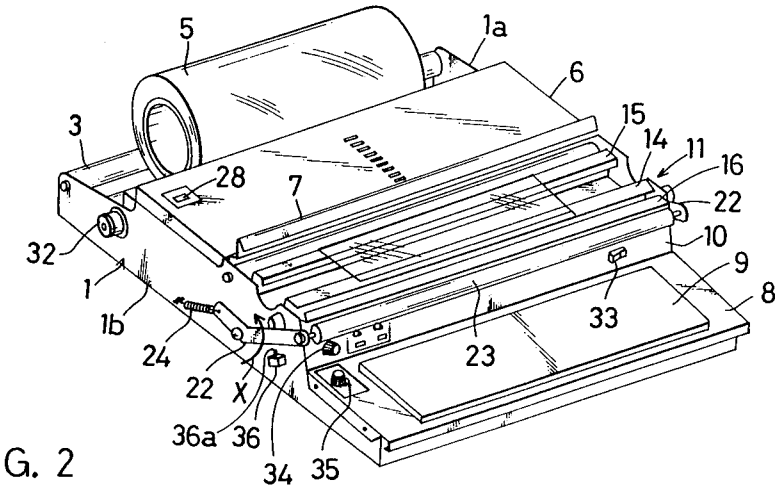
FIG. 1 is a perspective view of a hand wrapping apparatus.
Figure 2:
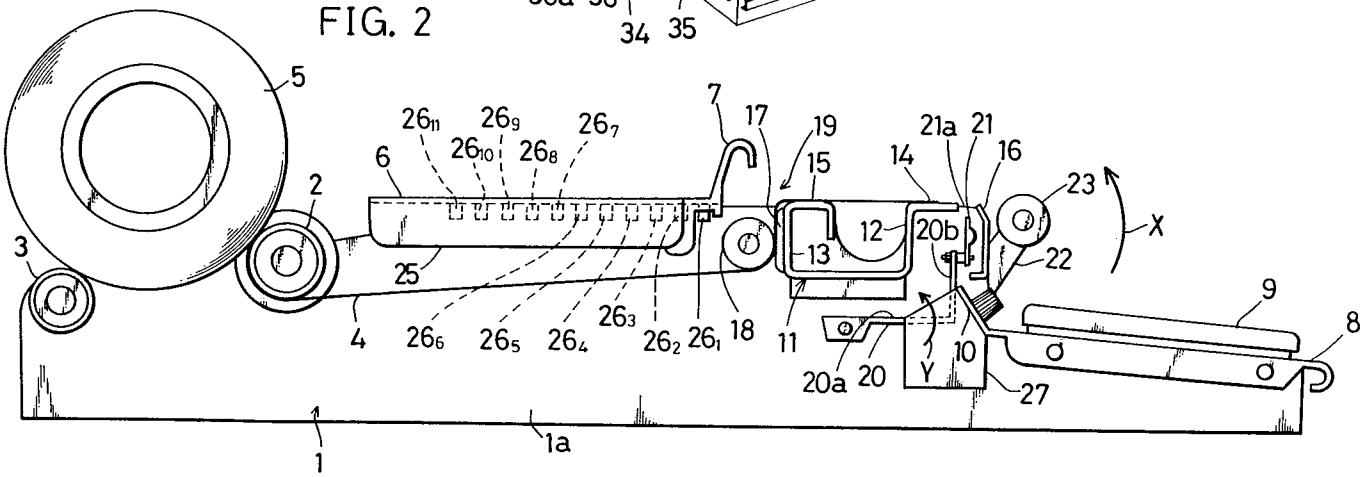
FIG. 2 is an enlarged longitudinal cross sectional view of the hand wrapping apparatus.

Referring to the drawings and first to FIGS. 1 and 2, there is shown a hand wrapping apparatus. Numeral 1 designates a flat-shaped frame which has a pair of horizontally spaced support rollers 2, 3 at the rear portion. On the rollers 2, 3 is supported a film roll 5 in a manner that the roll engages its outer periphery with those of the rollers. The film 4, which is made from web-like transparent plastic material, is stained in a color, for example, red, which is differently colored from product to be wrapped for the reason which will be evident hereinafter. On the upper middle portion of the frame 1 is mounted a product rest 6, the front end of which extends upwardly to form an upright 7 having a configuration which is inversed J-shape in cross section. On the front portion of the frame 1 is mounted a pedestal 8, the rear end of which extends generally upwardly to form a control panel 10. The pedestal 8 has a heater panel 9 thereon to thermally seal the plastic film 4 as can be readily understood hereinafter. Between the upright 7 and the pedestal 8 is mounted a trough-shaped bar 11 in parallel relationship with the film roll 5. The bar 11 has its opposing walls in turn serve as a front rise wall 12 and rear rise wall 13. The walls 12 and 13 have flattened snubbers 14 and 15 respectively, both of which have a tendency to adhere to the plastic film 4 so as to stop the film 4 from sliding thereon. Between the rear rise wall 13 and the front end of the product rest 6 is defined a space in the nature of a film withdrawal port 19. A film withdrawal roller 18 is arranged within the port 19 to be slightly spaced from a guide plate 17 which is attached to the outer side of the rear rise wall 13. The guide plate 17 has a property to allow the film 4 to smoothly slide thereon.

An angle-shaped lever 20 is provided with its horizontal portion 20*a* pivoted and with its vertical portion 20*b* located between the front rise wall 12 and the control panel 10. The lever 20 has a thermal cutter 21 secured to the upper end of the vertical portion 20*b* so as to serve as a severing structure.

Between the front rise wall 12 and the heater panel 9 is positioned a guard plate 16 which is provided to protect persons and material around the apparatus from the possibility of contact with the cutter 21. The guard plate 16 has its upper end opposed to the front end of the flattened snubber 14 to form a slot 21*a* therebetween into which the cutter 21 is admitted.

A pair of rocker bars 22 and 22 are pivoted to the side walls 1*a* and 1*b* of the frame 1 for rocking movement, and are interconnected to the lever 20 via a link structure (not shown). Each of the rocker bars has one end positioned in the neighborhood of the guard plate 16 to mount a press roller 23 therebetween, and is biased by means of a tensile coil spring 24 to pivot in the direction of the arrow X (counterclockwise).

Such is the construction that upon the clockwise movement of the rocker bars 22, 22, the lever 20 pivots in the direction of arrow Y through the link structure to project the cutter 21 above the snubber 14 through the sot 21*a* as later revealed in detail.

Figure 5:
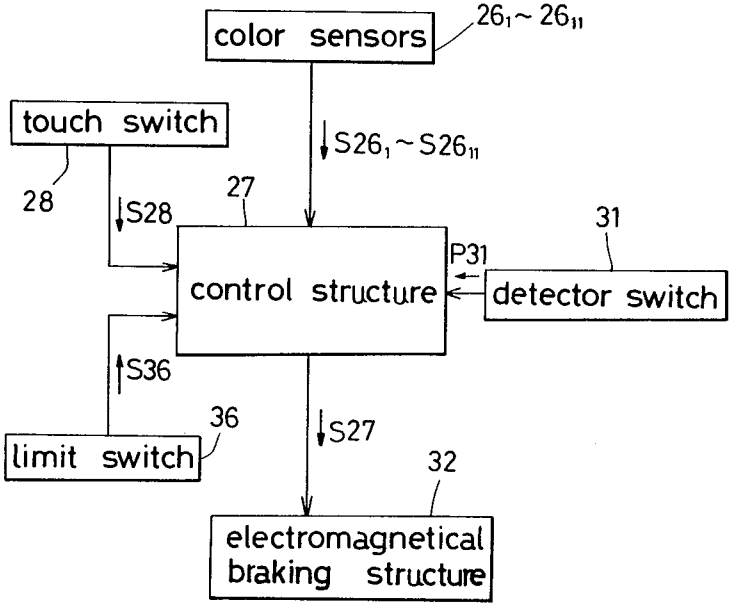
FIG. 5 is a block diagram including a film length determiner structure.

A film length determiner structure 25, comprises a row of photoelectric color sensors and a control structure 27 constituted from a microcomputer (FIG. 5). A plurality of color sensors $26_1$ through $26_{11}$ are arranged on the product rest 6 at intervals of, for example, 10 mm and align in a direction perpendicular to the film roll 5 with view to detecting red color. A touch switch 28 is incorporated with the product rest 6 to be operated as described hereinafter. A film length detector structure 29, FIGS. 3 and 4, comprises a detector disc 30 which is concentrically secured to the support roller 2 and a proximity switch 31. The disc 30 has a plurality of, for example, ten circumferential perforations 30*a* at regular intervals as seen in FIG. 4, and the same disc 30 has its outer periphery partly positioned in the neighborhood of the proximity switch 31, so that the switch 31 generates a single detector pulse each time that it detects a single perforation upon the rotational movement of the disc 30.

Figure 4:
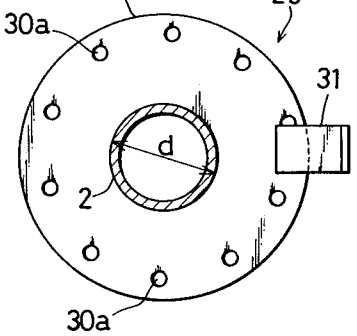
FIG. 4 is aa longitudinal cross sectional view of a film length detector structure.

In the illustrated embodiment, the support roller 2 is fabricated 32 mm in diameter as depicted at (d) in FIG. 4, so that the roller 2 allows approximately 100 mm of film to be withdrawn each time the roller turns through one complete revolution. This means that a single detector pulse is equivalent to the withdrawal of a b 10 mm length of film.

Figure 3:
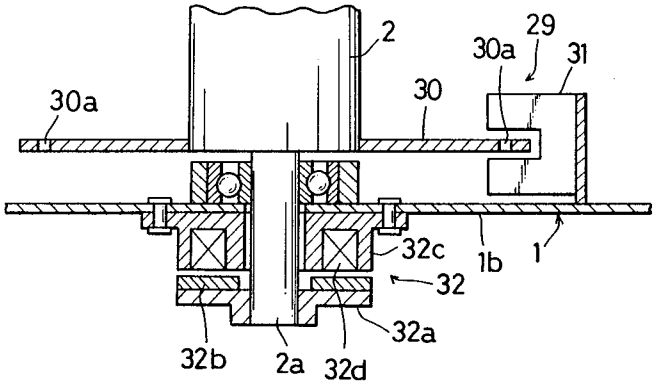
FIG. 3 is an enlarged, partial latitudinal cross sectional view showing an electromagnetic braking structure together with its periphery.

An electromagnetic braking structure 32, which acts as a lock structure, comprises a brake disc 32*a* secured to the shaft 2*a* of the roller 2, a circular shoe 32*b* attached to the disc 32*a*, and a brake block 32*c* having a solenoid 32*d* embedded therein and secured to the side wall 1*b* of the frame 1 as seen in FIG. 3. The disc 32*a* moves axially to bring the shoe 32*b* into frictional engagement with the block 32*c* so as to stop the movement of the roller 2 when the solenoid is energized.

Referring again to FIG. 1, the control panel 10 has mounted thereon an electrical power source switch 33 and a knob 34 which adjusts the thermal output of the heater panel 9. The pedestal 8 has a knob 35 and a limit switch 36 mounted thereon. The knob 35 adjusts the thermal input to the cutter 21 when the switch 36 is depressed at its finger 36*a* by the rocker bar 22 when it pivots in the direction opposite to arrow X.

The film length determiner structure 25 allows the control structure 27 to determine the withdrawal length of the film on the basis of the detector signal from the color sensors $26_1$ through $26_{11}$ so as to activate the braking structure 32 in accordance with the determined length of the film, as will be apparent from the following operation.

OPERATION

The film 4 on the roll 5 passes beneath the support roller 2, below the rest 6 and upwardly between the withdrawal roller 18 and the guide plate 17 to be introduced across the port 21*a*. The film 4 has its lead portion adhered to the surfaces of the snubbers 14 and 15.

(i) In the above situation, the power supply switch 33 is turned on to activate the heater panel 9, the thermal cutter 21, the color sensors, the control structure 27 and the proximity switch 31. The product C such as, for example, food B is put into a tray A and is placed on the rest 6.

Figures 6A, 6B, 6C:
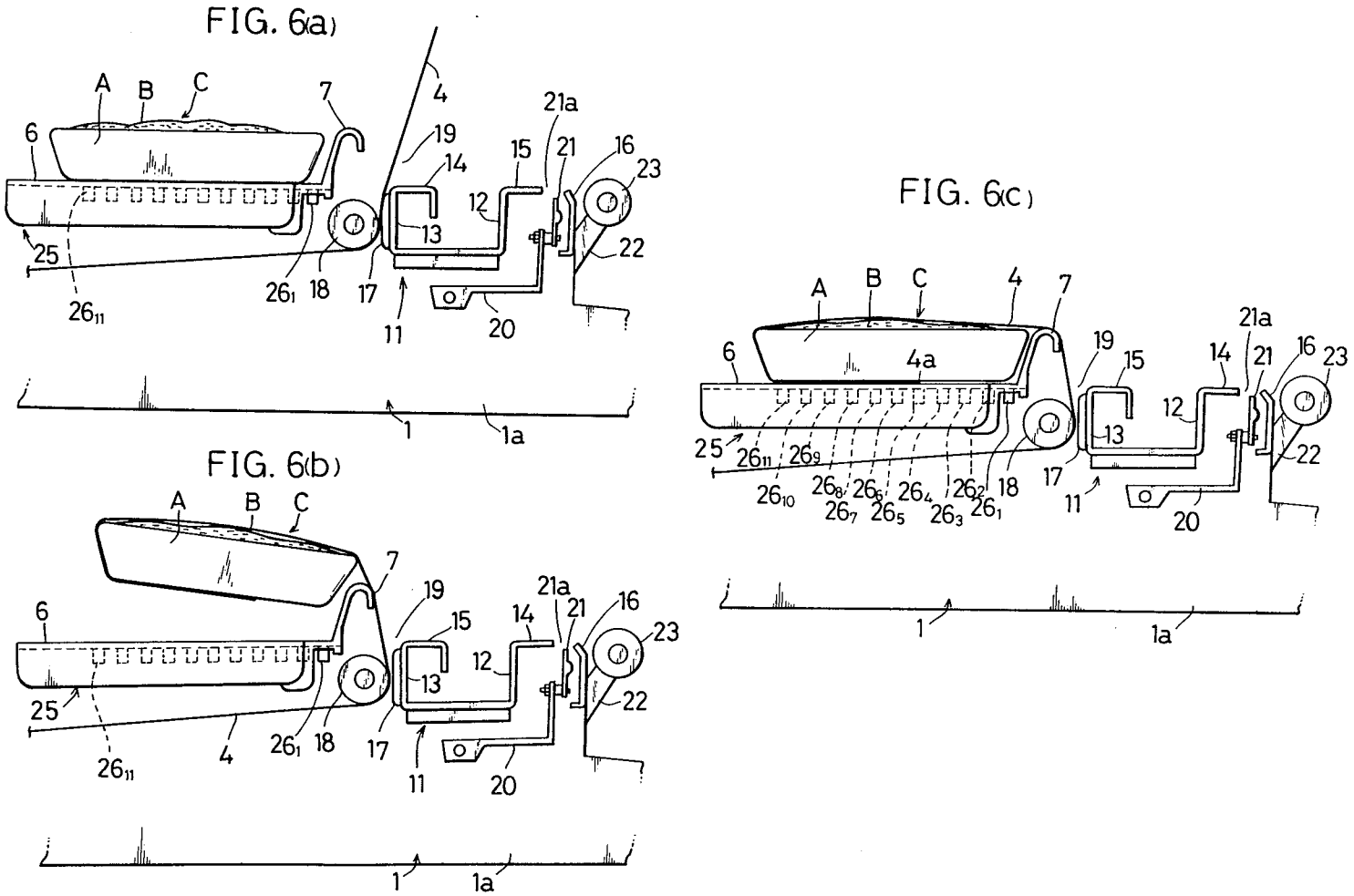
FIGS. 6 (*a*) through 6 (*e*) are longitudinal cross sectional views illustrating a hand wrapping apparatus together with the product for the purpose of showing the wrapping procedure, with the apparatus being partly broken away.
Figures 6D, 6E:
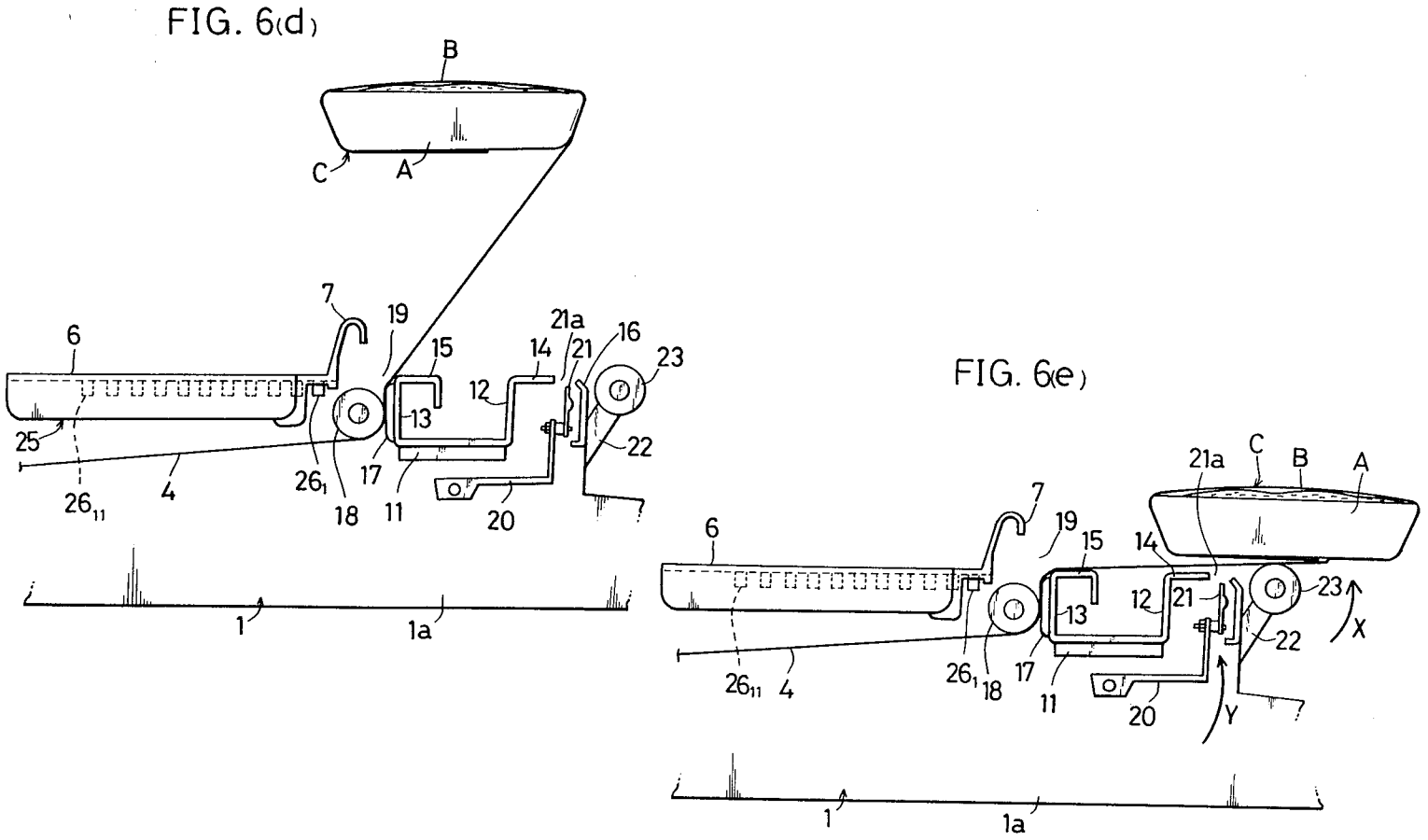

The film 4 is moved upwardly to separate its leading portion from the snubbers 14, 15, thus allowing it to be pulled out as seen in FIG. 6 (*a*).

(ii) The film 4 is moved toward the rest 6 and is thrown around the product C to cover from its topside to part of the underside as seen in FIG. 6 (*b*).

(iii) The product C which is partially covered by the film 4 is placed on the rest 6 with its front end located at the upright 7, and simultaneously the touch switch 28 is turned on.

The color sensors $26_1$, through $26_{11}$ are respectively adapted to generate detector signals $S26_1$ through $S26_{11}$ to feed them into the control structure 27 when the sensors detect the color. The control structure 27, upon activating the touch switch 28, is ready to have its built-in memory circuit (not shown) successively memorize the presence of the detector signals.

In the situation as seen in FIG. 6 (*c*) in which the film positions its leading end 4*a* at the color sensor $26_5$, the memory circuit memorizes the detector signals $26_5$ through $26_{11}$ coming from the corresponding sensors, and detects the absence of the signals $26_1$ through $26_4$ to calculate that the distance between the end 4*a* of the film 4 and the front end of the product C is 40 mm since the sensors are arranged at intervals of 10 mm. This results in a determiner signal, which corresponds to 40 mm length, being generated to be fed into a comparator circuit (not shown).

(iv) The product C is moved away from the rest 6 to pull out the film 4 as seen in FIG. 6 (*d*). With the pulling action of the film, the perforated disc 30 rotates together with the roller 2 to have the proximity switch 31 generate a detector pulse P31 each time the switch 31 detects a perforation of the disc 30.

The pulse P31 thus generated is fed into a counter circuit (not shown) to be counted at its number, causing a counter signal to be produced and to be fed into the comparator circuit. When the number counted by the counter circuit accords with the determiner signal fed into the comparator circuit as mentioned hereinbefore, the control structure 27 produces driver signal S27 to be fed into the electromagnetic braking structure 32 to energize it.

The braking structure 32 thus energized causes the brake disc 32*a* to frictionally engage with the block 32*c* so as to stop the roller 2, and to prevent the film from being further pulled out. This means that the film allowed to be withdrawn is 40 mm in length as initially determined in FIG. 6 (*c*).

In this instance, the film portion positioned at the port 19 corresponds to the front side area of the product C.

Figure 7:
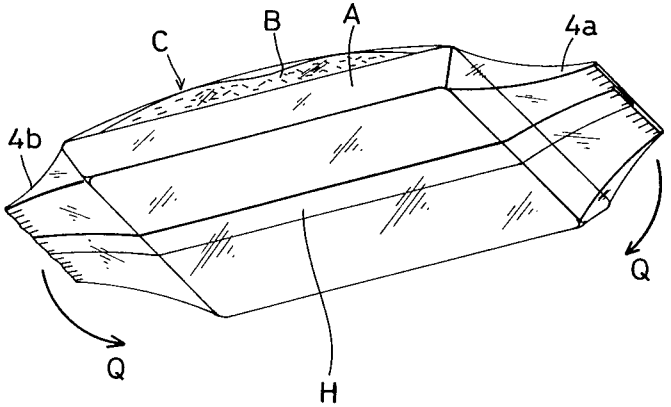
FIG. 7 is a perspective view showing the product wrapped in film.

The product C, that is, the food laden tray is further moved as seen in FIG. 6 (*e*) to tautly stretch the film so as to make the film overlap at the underside of the tray A as later seen in FIG. 7, the width of the overlap being depicted by H for convenience. The tray A has its overlapped portion of the film depressed on the press roller 23. With the depressing movement of the tray A, the film portion positioned rearwardly of the tray A is adhered to the snubbers 14, 15 in the manner mentioned in FIG. 6(*a*). At the same time, the rocker bar 22 pivots in the counterclockwise direction to pivot the lever 20 in the direction of arrow Y, causing the cutter 21 to project through the slot 21*a*. The cutter 21 thus projected severs the film portion locating at the underside of the tray A to substantially wrap the product, although not shown in the drawings.

Note that the overlapped portion of the film H is equivalent to the elongation accrued from tautly stretching the film.

In so doing, the rocker bar 22 thus pivoted depresses the finger 36*a* of the limit switch 36 to produce a return signal S36, thus stopping the driver signal S27 to deenergize the braking structure 32 so as to release the roller 2. Then, the product C wrapped in the film has its lateral marginal wings 4*b* and 4*c* folded toward the underside of the tray A as indicated by arrows Q in FIG. 7. After folding the wings, the product C has its underside placed on the heater panel 9 to thermally weld the wings for sealing.

Figure 8:
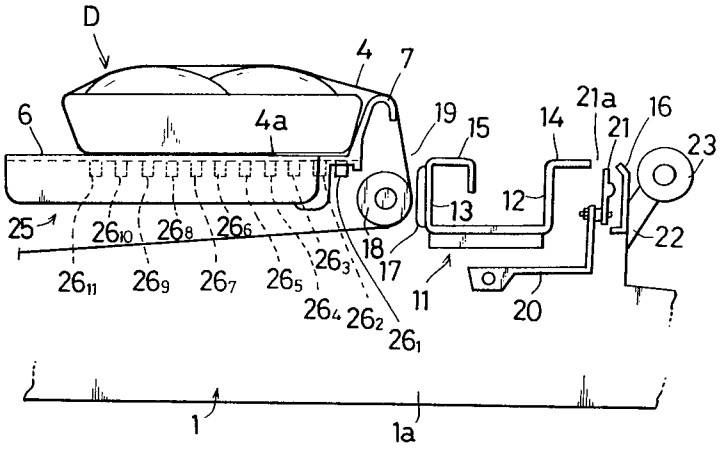
FIG. 8 is a view similar to FIG. 6 (*c*).

FIG. 8 shows another instance in which the leading end of the film is positioned at the color sensor $\mathbf{26}_4$ when product D having different dimension from the product C is placed on the rest 6. This placement allows the sensors $\mathbf{26}_4$ through $\mathbf{26}_{11}$ to produce detector signals to be fed into the control structure 27 as mentioned hereinbefore, resulting in a determiner signal which corresponds to the film length of 30 mm. This causes the braking structure 32 to be energized to lock the roller 2 upon pulling out a film length of 30 mm.

Thus the relevant length of the film required for a product to be wrapped can be determined so as to prevent waste of the film. There will be neither surplus nor shortage of the withdrawn film, and at the same time, a positive wrapping can be executed irrespective of where the leading end of the film may be positioned on the product.

It is appreciated that photoelectric switch means may be employed instead of the color sensors to detect the leading end of the film by comparing reflection from the film with that from the product particularly when the film is colorless and transparent.

Still further, it will be appreciated that intervals between the color sensors may not always be confined to 10 mm.

While the form of the invention now preferred has been disclosed as required by statute, other forms may be used, all coming within the scope of the claimed subject matter which follows:

What is claimed is:

1. A hand wrapping apparatus comprising:

a frame structure;

a film roll supported on a pair of spaced support rollers mounted on one side of said frame structure, and having its outer periphery engaged with the outer periphery of said rollers;

a film withdrawal port provided at the other side of said frame structure to introduce the film on said filmroll exteriorly of said frame structure for covering the product to be wrapped;

a severing structure provided with said frame structure to sever the film introduced from said film withdrawal port;

a film length determiner structure to detect the leading end of the film thrown around the product to calculate the successive length of the film required for wrapping;

a film length detector structure to detect length of the film withdrawn as calculated by said determiner structure to produce a detector signal; and a lock structure to apply braking action to a said support roller to stop withdrawal of the film on the basis of the detector signal from said detector structure.

* * * * *